US009365799B2

(12) United States Patent
Randhava et al.

(10) Patent No.: US 9,365,799 B2
(45) Date of Patent: Jun. 14, 2016

(54) EXTRACTION OF IMMOBILIZED OIL USING MIXTURES OF FOOD GRADE SOLVENTS

(75) Inventors: Sarabjit S. Randhava, Evanston, IL (US); Todd Harvey, Schaumburg, IL (US); Ajaib S. Randhava, Streamwood, IL (US); Gregory Dicosola, Westmont, IL (US)

(73) Assignee: Syngest, Inc., Healdsburg, CA (US)

( * ) Notice: Subject to any disclaimer, the term of this patent is extended or adjusted under 35 U.S.C. 154(b) by 539 days.

(21) Appl. No.: 13/582,982

(22) PCT Filed: Mar. 10, 2011

(86) PCT No.: PCT/US2011/027976

§ 371 (c)(1),
(2), (4) Date: Mar. 12, 2013

(87) PCT Pub. No.: WO2011/112860

PCT Pub. Date: Sep. 15, 2011

(65) Prior Publication Data

US 2013/0197249 A1 Aug. 1, 2013

Related U.S. Application Data

(60) Provisional application No. 61/313,085, filed on Mar. 11, 2010.

(51) Int. Cl.

| | |
|---|---|
| ***C11B 1/00*** | (2006.01) |
| ***C11B 1/10*** | (2006.01) |
| ***C11B 1/04*** | (2006.01) |

(52) U.S. Cl.
CPC .... *C11B 1/10* (2013.01); *C11B 1/04* (2013.01)

(58) Field of Classification Search
CPC ..... C11B 1/10; C11B 1/04
USPC ..... 554/14
See application file for complete search history.

(56) References Cited

U.S. PATENT DOCUMENTS

2007/0037993 A1 * 2/2007 Cheryan ..... 554/8
2008/0176298 A1 7/2008 Randhava et al.

FOREIGN PATENT DOCUMENTS

WO WO 00/69280 A2 11/2000
WO WO 00/69280 A3 6/2001

OTHER PUBLICATIONS

International seasrch report and written opinion dated Nov. 25, 2011 for PCT Application No. US2011/027976.
Kwiatkowski, et al. Extraction of Oil from Ground Corn Using Ethanol. J. Amer. Oil Chem. Soc. 2002; 79(8):825-830.

* cited by examiner

*Primary Examiner* — Deborah D Carr
(74) *Attorney, Agent, or Firm* — Alexandra J. Baran

(57) ABSTRACT

The invention provides extraction of immobilized oil from an oil-containing feed using a food grade solvent. The food grade solvent may include ethyl acetate or ethyl lactate. The solvent may also include an ethanol co-solvent with the ethyl acetate or ethyl lactate. The solvent may be recaptured within the system and reused in the process.

16 Claims, 4 Drawing Sheets

PROCESS SCHEMATIC – ETHYL LACTATE & ETHANOL

PROCESS SCHEMATIC – ETHYL LACTATE & ETHANOL

PROCESS SCHEMATIC – ETHYL ACETATE & ETHANOL

EXTRACTION OF IMMOBILIZED OIL USING MIXTURES OF FOOD GRADE SOLVENTS

CROSS-REFERENCE

This application claims the benefit of U.S. Provisional Application No. 61/313,085, filed Mar. 11, 2010, which application is incorporated herein by reference.

BACKGROUND OF THE INVENTION

Currently, oil may be extracted from a feedstock using a solvent. Such solvents may not always yield efficient oil extraction. In some embodiments, the solvents may also be costly or not environmentally friendly.

A need exists for improved oil extraction techniques. A further need exists for improved solvents for use in oil extraction and oil extraction processes.

SUMMARY OF THE INVENTION

The invention provides systems and methods for extraction of immobilized oil. Various aspects of the invention described herein may be applied to any of the particular applications set forth below or for any other types of systems or methods for extracting immobilized oil from oil containing materials using mixtures of food grade solvents. The invention may be applied as a standalone system or method, or as part of an integrated oil production or extraction process. It shall be understood that different aspects of the invention can be appreciated individually, collectively, or in combination with each other.

In accordance with an aspect of the invention, a process for extracting immobilized oils from oil containing materials may be provided. The process may comprise providing an oil containing material, and providing a mixture of food grade solvents to said oil containing material, thereby extracting the immobilized oil from the oil containing materials. In some embodiments, the mixture of food grade solvents may comprise a blend of ethyl lactate and ethanol. In some other embodiments, the mixture of food grade solvents comprises a blend of ethyl acetate and ethanol.

Another aspect of the invention may be directed to a system for oil extraction comprising an extractor configured to receive an oil containing material and a food grade solvent from a solvent source including ethanol, and to produce a mixed effluent; a centrifuge configured to receive the mixed effluent and separate the mixed effluent into a plurality of streams; and a stripper configured to receive at least one of the plurality of streams, and separate the at least one stream into food grade oil, and additional products that are provided to the solvent source.

Other goals and advantages of the invention will be further appreciated and understood when considered in conjunction with the following description and accompanying drawings. While the following description may contain specific details describing particular embodiments of the invention, this should not be construed as limitations to the scope of the invention but rather as an exemplification of preferable embodiments. For each aspect of the invention, many variations are possible as suggested herein that are known to those of ordinary skill in the art. A variety of changes and modifications can be made within the scope of the invention without departing from the spirit thereof.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Figure 1:
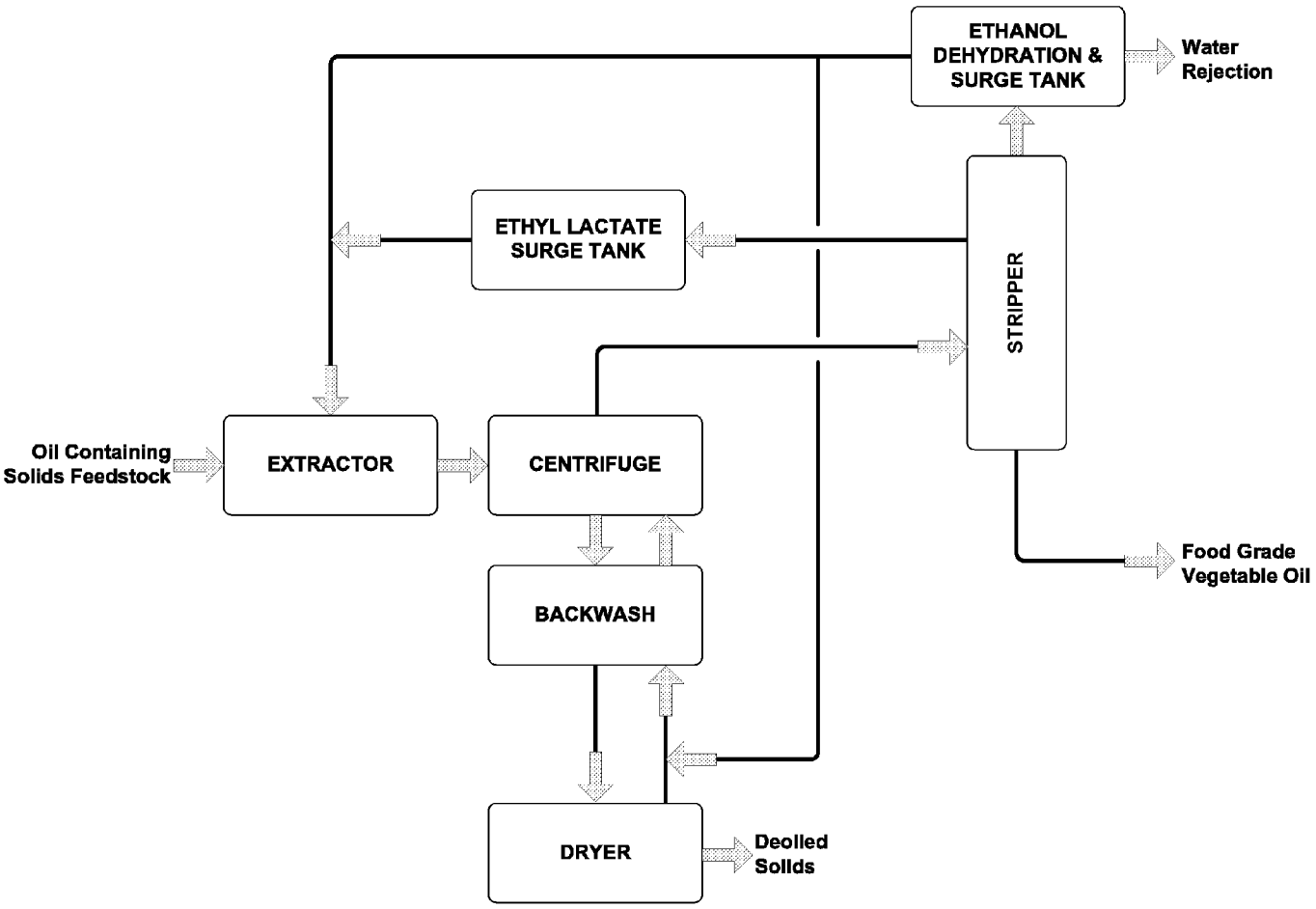
FIG. 1 shows a process schematic using a mixture of ethyl lactate and ethanol in accordance with an embodiment of the invention.

While preferable embodiments of the invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention.

In accordance with an aspect of the invention, an enhanced process for extracting immobilized oil from oil containing materials using mixtures of food grade solvents may be provided. The proposed process may specifically make use of one or more of the following solvent blends:

1. A mixture of ethyl lactate and ethanol for certain applications—hereinafter referred to as blend A, or
2. A mixture of ethyl acetate and ethanol for certain applications—hereinafter referred to as blend B.

Use of Ethanol as a Co-Solvent

A modulated addition of ethanol into ethyl lactate or into ethyl acetate may significantly increase the oil extraction properties of food grade solvents (e.g., blend A and blend B). In part, this may be due to the fact that ethanol contains both polar and non-polar groups, wherein the polar group tends to create a certain amount of "swelling" that facilitates the extractive action of the non-polar components in the solvent blend.

Depending upon the nature of the extraction application, in many instances, the extractive properties of the primary solvent can often be enhanced by the addition of an appropriate co-solvent. For example, when supercritical carbon dioxide is used to extract certain essential oils and fragrances from botanical materials, a small amount of water or ethanol can greatly improve the quantity and quality of the extracted product.

Likewise, as taught by Ishida, Chapman, Randhava and Randhava (U.S. Pat. No. 7,572,468 B1, Aug. 11, 2009), which is hereby incorporated by reference in its entirety, the addition of ethanol as a co-solvent in ethyl lactate can greatly enhance its effectiveness in extracting carotenoids from plant material.

In the case of blend A, the ethanol co-solvent may also inhibit the formation of lactic acid from the contact between the ethyl lactate and any water contained in a feed material.

The above examples notwithstanding, the proposed process advantageously uses ethanol as a co-solvent for the extraction of oils, wherein the extractive access of the non-polar compounds to the immobilized oil may be facilitated by the polar groups contained in the ethanol co-solvent. Thus, the proposed process may provide an improved method for extracting immobilized oil using an ethanol co-solvent.

Safety and Health Considerations

According to the US Food and Drug Administration, ethyl lactate, ethyl acetate and ethanol are all certified as GRAS (Generally Recognized as Safe) food additives. It is also notable that each of these three compounds—ethyl lactate, ethyl acetate and ethanol—is also individually 100% environmentally friendly and 100% biodegradable.

The proposed process overcomes the health concerns associated with the use of petroleum and petrochemical solvents such as hexane, and is much safer for the workers and other personnel involved in the extraction operations.

Process Description—Ethyl Lactate and Ethanol—Blend A

A block schematic of an oil extraction process using a blend of ethyl lactate and ethanol is presented in FIG. 1. The blend of ethyl lactate and ethanol may have any proportion or combination of ethyl lactate and ethanol. In preferable embodiments, the ethanol co-solvent in this blend can range from 1% to 25% by volume. For example, the ethanol co-solvent in this blend may be about 1%, 3%, 5%, 8%, 10%, 12%, 15%, 18%, 20%, 22%, or 25% by volume. In alternate embodiments, an ethyl lactate extraction solvent may be used blended with other solvents. The amount of ethyl lactate in the blend (e.g., by volume) may be about 75% or greater, 80% or greater, 85% or greater, 90% or greater, 95% or greater, or 99% or greater. Any of the relative amounts discussed herein may be based on volume or mass. As previously discussed, ethanol may be a preferable co-solvent. In some embodiments additional co-solvents may be used, different co-solvents may be used, or no other co-solvents may be used. In some embodiments, the ratio of ethyl lactate:ethanol may be 75:25 or greater, 80:20 or greater, 85:15 or greater, 90:10 or greater, 95:5 or greater, or 99:1 or greater. The relative amounts may be based on volume or mass.

In some embodiments, a solvent or component may be provided in a solvent surge tank or any other container suitable for the storage of the solvent component. For example, ethyl lactate and ethanol may be provided within an ethyl lactate and ethanol surge tank. In preferable embodiments, ethyl lactate may be provided within an ethyl lactate surge tank, or any other containers suitable for storage of ethyl lactate. Similarly, ethanol may be provided within an ethanol surge tank, or any other container suitable for storage of ethanol. The solvent (which may include ethyl lactate and ethanol) may be mixed or prepared prior to entering an oil extraction system, or the components may remain combined within the system. For example, in some instances they may be provided within a solvent surge tank. Alternatively, the components of the solvent (e.g., ethyl lactate and ethanol) may be mixed or combined within the system prior to entering an extractor, or they may be provided separately to the extractor and mixed or combined therein.

An oil containing feedstock may be provided to the system. In some embodiments, the oil-containing feedstock may include a plant or non-plant material. The feedstock may yield an edible or inedible oil. In some embodiments, the feedstock may be a solid, or may include solid components. In some embodiments, the feedstock may have a moisture component. The moisture component may be about 50% or less, 40% or less, 30% or less, 20% or less, 15% or less, 10% or less, or 5% or less. Additional examples of feedstock will be discussed in greater detail elsewhere herein.

An oil containing feedstock and a mixture of ethyl lactate and ethanol may be intimately contacted in an extractor for a time period. The time may vary depending on the feedstock material and the size of the sample and the desired degree of extraction. Preferably, the time period that can vary from a few minutes to several hours. For example, the feedstock and solvent may be contacted for 1 minute or more, 5 minutes or more, 10 minutes or more, 15 minutes or more 20 minutes or more, 30 minutes or more 45 minutes or more, 1 hour or more, 1 hour and 15 minutes or more, 1 and a half hours or more, 2 hours or more, 2 and a half hours or more, 3 hours or more, 3 and a half hours or more, 4 hours or more, or 5 hours or more.

Depending upon the physical characteristics of the feedstock, the weight ratio of the solvent mixture and the oil containing feedstock may vary. Preferably, the weight ratio can range from 0.50 to 4.00. For example the weight ratio of solvent mixture to the feedstock may be about 0.5, 1.0, 1.5, 2.0, 2.25, 2.5, 3.0, 3.25, 3.5, or 4.0.

In some embodiments, the extraction may occur at a controlled temperature. Alternatively, the temperature need not be controlled. In some embodiments, extraction may occur at a temperature range of about 20 to 90 degrees centigrade ("degrees C"), 35 to 80 degrees C., 40 to 70 degrees C., or 50 to 65 degrees C. For example, the temperature during extraction may be about 25, 30, 35, 40, 45, 50, 55, 60, 65, 70, 75, or 80 degrees C. or higher. The temperature during an extraction process may remain substantially steady or may vary during the process.

The extractor may produce a mixed effluent. The mixed effluent from the extractor may contain solid material, oil, water, and solvent (e.g., ethyl lactate and ethanol). The mixed effluent may be fed into a centrifuge that serves to separate the input into two streams: 1) a liquid containing oil, water, and solvent (e.g., ethyl lactate and ethanol) and 2) a "wet" cake containing the solid residue, and reduced amounts of ethyl lactate, ethanol and water.

The "wet" cake may be subjected to a vigorous counter-current backwash with ethanol supplied from the ethanol surge tank. Alternatively, the ethanol may be supplied by any other source that may be part of the oil extraction system or external to the oil extraction system. The backwash may result in a liquid stream and a washed solid residue. The liquid stream from this unit operation may go back into the centrifuge, while the washed solid residue containing reduced amounts of ethyl lactate, ethanol and water may be fed into a dryer. The dryer may output a liquid component and a dry deoiled solid. The liquid components—ethyl lactate, ethanol and water—may be vaporized and returned into the washer, leaving a dry deoiled residue as a finished secondary product.

The liquid stream from the centrifuge, which may contain the oil, ethyl lactate, ethanol and water, may go into a stripper that may separate the input stream into three distinct components: 1) food grade oil, 2) ethyl lactate, and 3) ethanol and water. The food grade oil may be a vegetable oil. In other embodiments, the output may be any sort of oil that was the desired extraction product, whether the oil be a food grade oil, any edible oil, or any inedible oil. The ethyl lactate may be transported to the ethyl lactate surge tank. Alternatively, the ethyl lactate may exit the oil extraction process. The ethanol and water may be transported to the ethanol dehydration and surge tank. After dehydration, the ethanol may be within its own ethanol surge tank and a water rejection may be provided.

In alternate embodiments, this process may be utilized with various solvents. For example, a solvent which may include ethyl acetate and ethanol may be used.

Figure 2A:
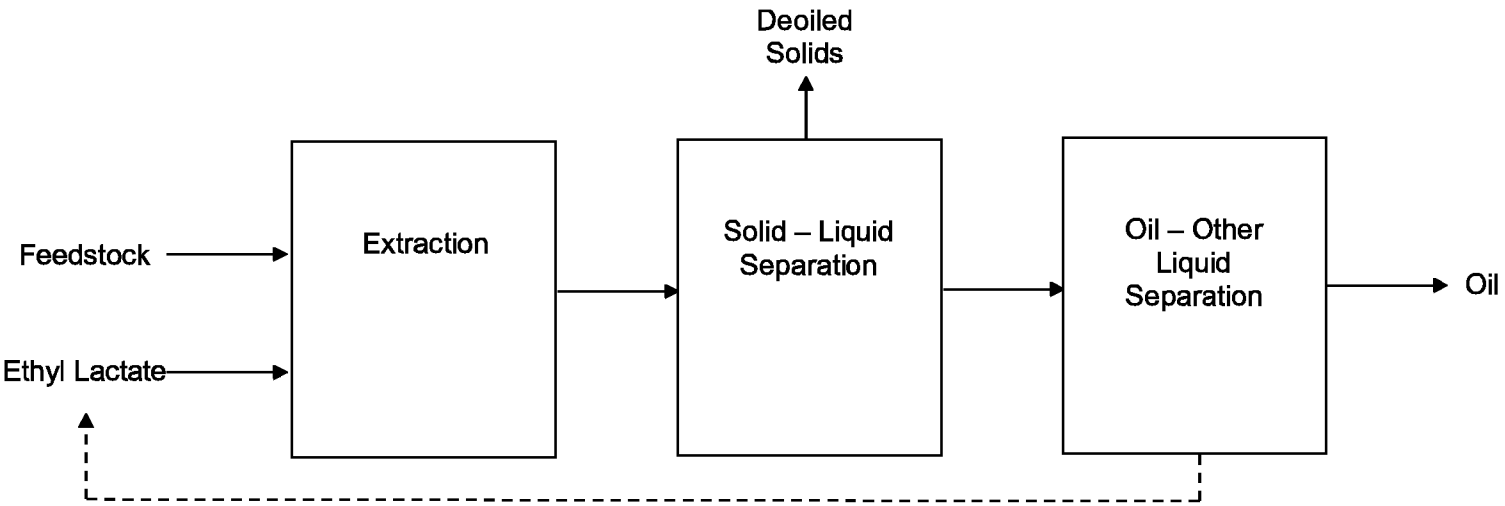
FIG. 2A shows a simplified process for extracting oil from a feedstock.

FIG. 2A shows a simplified process for extracting oil from a feedstock. A feedstock and a solvent, which may be a food grade solvent that may include ethyl lactate and ethanol may be provided in an extraction step. During an extraction step, they may enter in an extractor for a desired (or predetermined) amount of time. The contact may occur under other variable conditions, which may include temperature, relative amount of feedstock and solvent, or the relative amounts of co-solvents within the solvent mixture. The conditions of the extraction step may vary depending on factors, such as the make-up (or composition) or amount of feedstock, or other factors to be discussed elsewhere herein.

Following an extraction step, a solid-liquid separation step may be provided. A mixed effluent that is a product of the extraction step may be provided to the solid-liquid separation step. In a solid-liquid separation step, the mixed effluent may be separated to form a solid product and a liquid product. In the solid-liquid separation step, a solid product, such as a dry deoiled residue, may be produced by the system. The liquid component, may include a liquid comprising oil, water, and a solvent (which may include ethyl lactate and ethanol). The solid-liquid separation step may include processes such as centrifugation, backwashing, and/or drying, as discussed elsewhere herein. Any other process that may assist with separation of solid and liquid components may be used.

A liquid separation step that may separate a desired oil product from other liquids may be provided following the solid-liquid separation step. The liquid component of the solid-liquid separation step may be provided to the oil-other liquid separation step. In the oil-other liquid separation step, a desired oil product, such as a food grade vegetable oil, may be separated from the other liquids, which may include water and another liquid, such as solvent. The solvent may include ethyl lactate and ethanol. The other liquids may be further separated in the liquid separation step. Water may be separated from the solvent, providing a water rejection output. In some instances, the solvent may be kept together, or may be further separated into one or more co-solvents. For example, the solvent may be separated into ethyl lactate and ethanol.

In some embodiments, the solvent may be re-used or provided in an extraction step. The solvent may have been kept together, or may have been separated and then provided in the extraction step. For example, an ethyl lactate and ethanol solvent that may have been separated during the liquid separation step may be used in the extraction step. In some embodiments, the liquid separation may occur using one or more strippers, as described elsewhere herein.

Figure 2B:
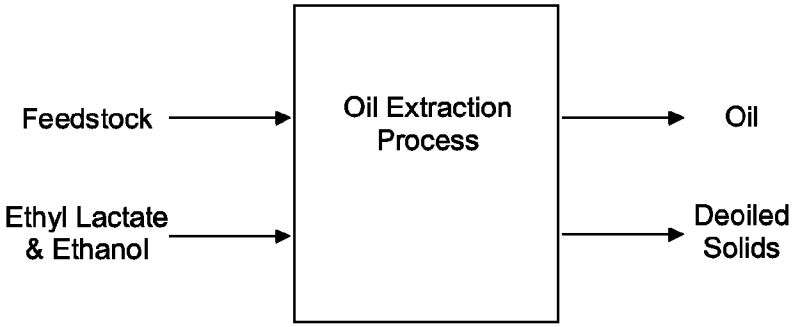
FIG. 2B shows a high level oil extraction process.

FIG. 2B shows a further simplified oil extraction process. A feedstock and a solvent, which may be a food grade solvent, may be provided in an oil extraction process. The solvent may primarily include ethyl lactate. In some embodiments, ethanol may be provided as a co-solvent. Additional co-solvents may or may not be included.

The oil extraction process may result in an oil product. The oil product may be a food grade oil, such as vegetable oil. Examples of food grade oil may include vegetable oil, corn oil, olive oil, or mineral oil. In some embodiments, a solid product may be provided as well. The solid product may be a deoiled residue. In some embodiments, the solid product may be a high protein solid residue. The solid product may be suitable for human consumption. In some embodiments, water may be a byproduct of the system. The oil, solid, and/or water may be desired products of the system or byproducts.

Process Description—Ethyl Acetate and Ethanol—Blend B

Figure 3:
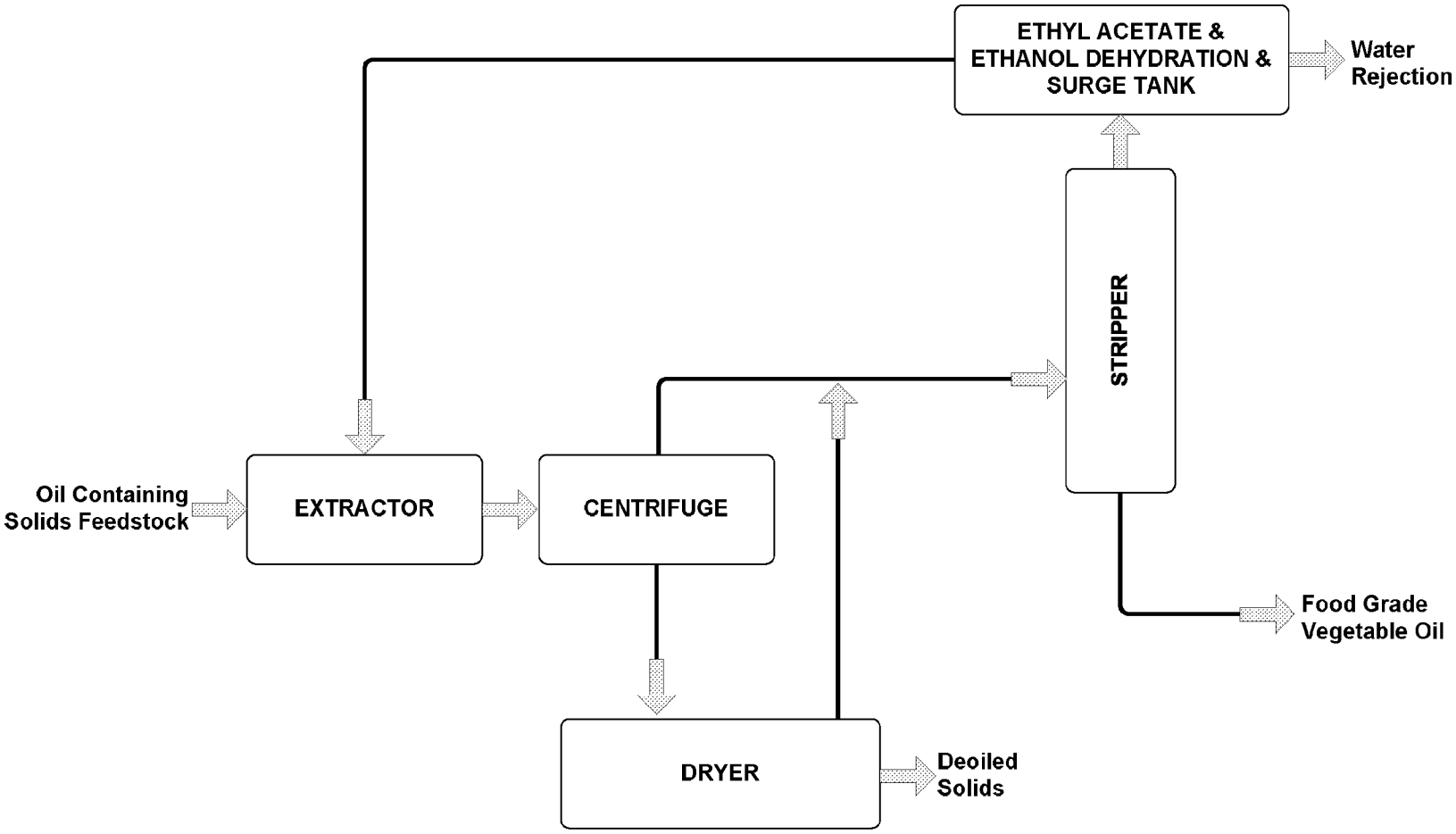
FIG. 3 shows a process schematic using a mixture of ethyl acetate and ethanol in accordance with another embodiment of the invention.

A block schematic of an oil extraction process using a blend of ethyl acetate and ethanol is presented in FIG. 3. The blend of ethyl acetate and ethanol may have any proportion or combination of ethyl acetate and ethanol. In preferable embodiments, the ethanol co-solvent in this blend can range from about 1% to 25% by volume. For example, the ethanol co-solvent in this blend may be about 1%, 3%, 5%, 8%, 10%, 12%, 15%, 18%, 20%, 22%, or 25% by volume. In alternate embodiments, an ethyl acetate extraction solvent may be used blended with other solvents. The amount of ethyl acetate in the blend (e.g., by volume) may be about 75% or greater, 80% or greater, 85% or greater, 90% or greater, 95% or greater, or 99% or greater. As previously discussed, ethanol may be a preferable co-solvent. In some embodiments additional co-solvents may be used, different co-solvents may be used, or no other co-solvents may be used. In some embodiments, the ratio of ethyl acetate to ethanol may be 75:25 or greater, 80:20 or greater, 85:15 or greater, 90:10 or greater, 95:5 or greater, or 99:1 or greater.

In some embodiments, a solvent may be provided in a solvent surge tank or any other container suitable for the storage of the solvent. For example, ethyl acetate and ethanol may be provided within an ethyl acetate and ethanol surge tank. In alternate embodiments, ethyl acetate may be provided within an ethyl acetate surge tank, or any other containers suitable for storage of ethyl acetate. Similarly, ethanol may be provided within an ethanol surge tank, or any other container suitable for storage of ethanol. The solvent (which may include ethyl acetate and ethanol) may be mixed or prepared prior to entering an oil extraction system, or the components may remain combined within the system. For example, in some instances they may be provided within a solvent surge tank. Alternatively, the components of the solvent (e.g., ethyl acetate and ethanol) may mixed or combined within the system prior to entering an extractor, or they may be provided separately to the extractor and mixed or combined therein.

An oil containing feedstock may be provided to the system, as previously described. In some embodiments, the oil-containing feedstock may include a plant or non-plant material. The feedstock may yield an edible or inedible oil. In some embodiments, the feedstock may be a solid, or may include solid components. In some embodiments, the feedstock may have a moisture component. The moisture component may be about 50% or less, 40% or less, 30% or less, 20% or less, 15% or less, 10% or less, or 5% or less. Additional examples of feedstock will be discussed in greater detail elsewhere herein.

An oil containing feedstock and a solvent, which may include a mixture of ethyl acetate and ethanol, may be intimately contacted in an extractor for a time period. The time may vary depending on the feedstock material and the size of the sample and the desired degree of extraction. Preferably, the time period that can vary from a few minutes to several hours. For example, the feedstock and solvent may be contacted for 1 minute or more, 5 minutes or more, 10 minutes or more, 15 minutes or more 20 minutes or more, 30 minutes or more 45 minutes or more, 1 hour or more, 1 hour 15 minutes or more, 1 and a half hours or more, 2 hours or more, 2 and a half hours or more, 3 hours or more, 3 and a half hours or more, 4 hours or more, or 5 hours or more.

Depending upon the physical characteristics of the feedstock, the weight ratio of the solvent mixture and the oil containing feedstock may vary. Preferably, the weight ratio can range from 0.50 to 4.00. For example the weight ratio of solvent mixture to the feedstock may be about 0.5, 1.0, 1.5, 2.0, 2.25, 2.5, 3.0, 3.25, 3.5, or 4.0.

In some embodiments, the extraction may occur at a controlled temperature. Alternatively, the temperature need not be controlled. In some embodiments, extraction may occur at a temperature range of about 30 to 80 degrees C., 35 to 70 degrees C., or 50 to 65 degrees C. For example, the temperature during extraction may be about 25, 30, 35, 40, 45, 50, 55, 60, 65, 70, 75, or 80 degrees C. or higher. The temperature during an extraction process may remain substantially steady or may vary during the process.

The extractor may produce a mixed effluent. The mixed effluent from the extractor may contain solid material, oil, water, and solvent (e.g., ethyl acetate and ethanol). The mixed effluent may be fed into a centrifuge that serves to separate the input into two streams: 1) a liquid containing oil, water, and solvent (e.g., ethyl acetate and ethanol) and 2) a "wet" cake containing the solid residue, and reduced amounts of ethyl acetate, ethanol and water.

The liquid stream from the centrifuge, which may contain the oil, water, and a solvent (e.g., ethyl acetate and ethanol) may go into a stripper.

The "wet" cake from the centrifuge may contain reduced amounts of ethyl acetate, ethanol and water. Preferably, the "wet" cake may be fed into a dryer. The dryer may output a liquid component and a dry deoiled solid. The liquid components—ethyl acetate, ethanol and water—may be vaporized and diverted into the stripper, leaving a dry deoiled residue as the finished secondary product.

The stripper may separate the input stream into two distinct components: 1) food grade oil, and 2) a solvent blend. The food grade oil may be a vegetable oil. In other embodiments, the output may be any sort of oil that was the desired extraction product, whether the oil be a food grade oil, any edible oil, or any inedible oil. The solvent blend may include ethyl acetate and ethanol. The solvent blend may be dehydrated and diverted into a surge tank. In some embodiments, the solvent may be diverted into an ethyl acetate and ethanol dehydration and surge tank. Alternatively, the solvent may exit the oil extraction process and system. After dehydration, the solvent may be in its own ethyl acetate and ethanol surge tank and a water rejection may be provided.

In alternate embodiments, the stripper may separate the input stream into three distinct components: 1) food grade oil, 2) ethyl acetate, and 3) ethanol and water. The ethyl acetate may be transported to an ethyl acetate surge tank. Alternatively, the ethyl acetate may exit the oil extraction process. The ethanol and water may be transported to the ethanol dehydration and surge tank. After dehydration, the ethanol may be within its own ethanol surge tank and a water rejection may be provided. The ethyl acetate and the ethanol may then be mixed in the desired amounts to form the solvent used for extraction.

In additional alternate embodiments, this process may be utilized with various solvents. For example, a solvent which may include ethyl lactate and ethanol may be used.

Figure 4A:
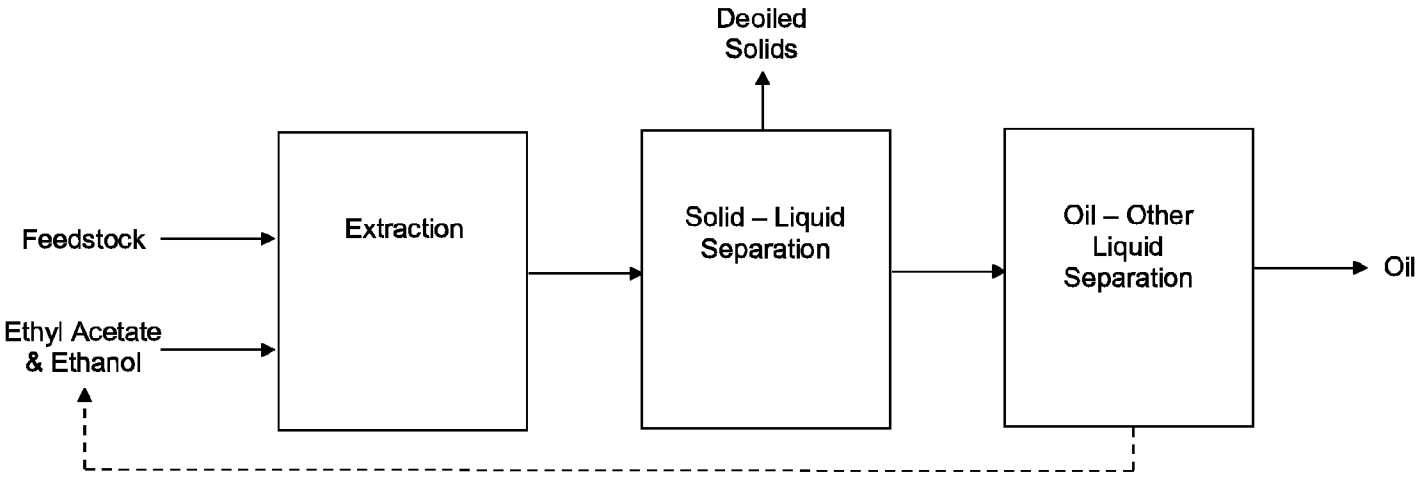
FIG. 4A shows a simplified process for extracting oil from a feedstock.

FIG. 4A shows a simplified process for extracting oil from a feedstock, which may be an oil-containing material. A feedstock and a solvent, which may be a food grade solvent which may include ethyl acetate and ethanol may be provided in an extraction step. During an extraction step, they may enter in an extractor for a desired amount of time. The contact may occur under other variable conditions, which may include temperature, relative amount of feedstock and solvent, or the relative amounts of co-solvents within the solvent mixture. The conditions of the extraction step may vary depending on factors, such as the make-up or amount of feedstock, or other factors to be discussed elsewhere herein.

Following an extraction step, a solid-liquid separation step may be provided. A mixed effluent that is a product of the extraction step may be provided to the solid-liquid separation step. In a solid-liquid separation step, the mixed effluent may be separated to form a solid product and a liquid product. In the solid-liquid separation step, a solid product, such as a dry deoiled residue, may be produced by the system. The liquid component, may include a liquid comprising oil, water, and a solvent (which may include ethyl acetate and ethanol). The solid-liquid separation step may include processes such as centrifugation, backwashing, and/or drying, as discussed elsewhere herein. Any other process that may assist with separation of solid and liquid components may be used.

A liquid separation step that may separate a desired oil product from other liquids may be provided following the solid-liquid separation step. The liquid component of the solid-liquid separation step may be provided to the oil-other liquid separation step. In the oil-other liquid separation step, a desired oil product, such as a food grade vegetable oil, may be separated from the other liquids, which may include water and solvent. The solvent may include ethyl acetate and ethanol. The other liquids may be further separated in the liquid separation step. Water may be separated from the solvent, providing a water rejection output. In preferable instances, the solvent may be kept together, or may be further separated into one or more co-solvents. For example, the solvent may be separated into ethyl acetate and ethanol.

In some embodiments, the solvent may be re-used or provided in an extraction step. The solvent may have been kept together, or may have been separated and then provided in the extraction step. For example, an ethyl acetate and ethanol solvent that may be kept together during the liquid separation step may be used in the extraction step. In some embodiments, the liquid separation may occur using a stripper, as described elsewhere herein.

Figure 4B:
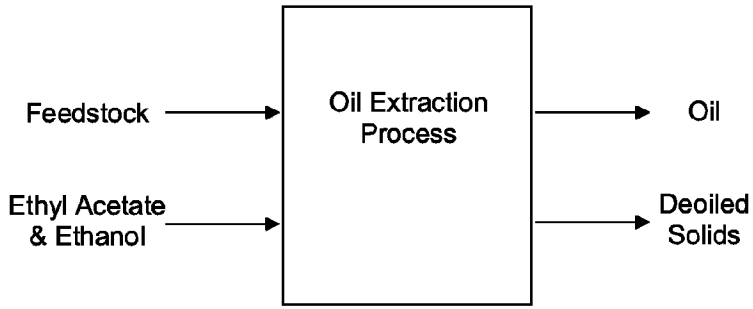
FIG. 4B shows a high level oil extraction process.

FIG. 4B shows a further simplified oil extraction process. A feedstock and a solvent, which may be a food grade solvent, may be provided in an oil extraction process. The solvent may primarily include ethyl acetate. In some embodiments, ethanol may be provided as a co-solvent. Additional co-solvents may or may not be included.

The oil extraction process may result in an oil product. The oil product may be a food grade oil, such as vegetable oil. Examples of food grade oil may include vegetable oil, corn oil, olive oil, or mineral oil. In some embodiments, a solid product may be provided as well. The solid product may be a deoiled residue. In some embodiments, the solid product may be a high protein solid residue. The solid product may be suitable for human consumption. In some embodiments, water may be a byproduct of the system. The oil, solid, and/or water may be desired products of the system or byproducts.

It will be appreciated that other unit operations, such as heat exchangers, pumps, distillation columns, and absorption columns, can be used to facilitate the extraction of oil from an oil-containing material, in addition to separating ethanol and one of ethyl acetate and ethyl lactate from process mixtures. In some cases, it may be desirable to separate ethanol from a solution comprising ethanol and one of ethyl acetate and ethyl lactate. In such a case, in an embodiment, the extraction and separation processes of various embodiments of the invention can be coupled with the use one or more distillation columns. In some cases, it may be desirable to heat the oil-containing material prior to processing. In such a case, in an embodiment, a heat exchanger can be used. In certain embodiments, a plurality of unit operations, such as a plurality of strippers (or stripping columns), can be used.

Choosing Between Blend A and Blend B

Given a particular oil extraction application, the decision of whether to use blend A or blend B can be rationalized by conducting a series of simple comparative laboratory experiments to measure the yield of oil that is extracted.

The design of experiments may make use of a frugal heuristic procedure commonly known as the "hill climbing" algorithm. An objective may be to seek and follow directional steps that are likely to offer the greatest increase in "altitude" at each point in the experimental protocol. In one embodiment, the "evaluation function" may be the percentage yield of the extracted oil, a measure that may be analogous to the "altitude."

Any computer readable media with logic, code, data, instructions, may be used to implement any algorithm, calculations, or steps or methodology. Computer readable media may reside in a memory on a computer, or any other device.

In general, we have found that the following factors and variables can have an influence on whether blend A or blend B is better suited for a given application:

Weight percentage of oil in the feedstock.

Weight percentage of water in the feedstock.

Particle size and size distribution of the feedstock.

Preferred temperature for extraction.

Preferred pressure for extraction

A decision process may be provided where one or more factors may be considered. The factors may include any of the factors listed above and any additional factors that may influence a desired solvent blend. After the factors have been considered, it may be determined whether blend A or blend B is preferable. In some circumstances, blend A may be preferable while in other circumstances blend B may be preferable. This determination may be made on data generated from the laboratory experiments described. This determination may also be based on algorithms or calculations performed by a computer or any other computing device.

No Feedstock Limitations

While the most profitable applications of the proposed technology will be directed at the extraction of edible oils, there is no reason why this technology cannot be also similarly used for non-edible oils from plant material or any non-plant material. Examples of plant materials that can be used as feedstocks to yield edible oils include corn, soybeans, canola seed, wheat, various types of algae, etc.

Examples of plant materials that can be used as feedstocks to yield non-edible oils include castor beans, jatropha, pongamia, oil containing wood chips such as pine, cedar and others, etc.

An example of a non-plant material that can be used as a feedstock to yield edible oil is fish meal. A non-plant feedstock that will yield a non-edible oil is tar sands.

Economic Considerations

The proposed extraction process has been designed to maximize or increase the extraction of the desired oil end product, maximize or increase the recovery and reuse of the solvents, and to minimize or reduce energy requirements.

Economic modeling conducted by the inventors clearly indicates that, after taking all capital and operating cost factors into consideration, the proposed process may be most cost-effective when the throughput of the feedstock is between 25,000 and 150,000 tons per year, and the weight percentage of the oil content in the feedstock is equal to or higher than 15%.

However, from a purely theoretical perspective, the process is not limited by the throughput of the oil containing feedstock, or by the weight percentage of the contained oil. Any throughput may be implemented (e.g., 100 tons, 1,000 tons, 10,000 tons, 20,000 tons, 25,000 tons, 30,000 tons, 50,000 tons, 60,000 tons, 70,000 tons, 80,000 tons, 90,000 tons, 100,000 tons, 150,000 tons, 200,000 tons, 300,000 tons, 500,000 tons, or 1,000,000 tons a year), and any weight percentage of oil content may be used (e.g., 1% or greater, 5% or greater, 10% or greater, 13% or greater, 15% or greater, 16% or greater, 17% or greater, 18% or greater, 20% or greater, 22% or greater, 25% or greater, or 30% or greater).

Depending upon the nature of the feedstock, in addition to the oil that is derived, the residue may also represent a valuable co-product. The residue may be a deoiled solid. For example, if the feedstock is comprised of corn germ, the proposed process will yield both high quality edible corn oil and a high protein value residue suitable for human consumption.

EXAMPLE

A set of basic experiments were conducted with relation to the extraction of immobilized oil using mixtures of food grade solvents, such as the invention described herein.

Objective

The experimental protocol was designed to compare the relative effectiveness of various food grade solvents and mixtures for extracting immobilized oil from oil containing materials. The specific solvents and mixtures that were tested were:

1. Ethanol
2. Ethyl lactate
3. Ethyl acetate
4. Mixture of 95% ethyl lactate and 5% ethanol by volume (Blend A1)
5. Mixture of 85% ethyl lactate and 15% ethanol by volume (Blend A2)
6. Mixture of 95% ethyl acetate and 5% ethanol by volume (Blend B1)
7. Mixture of 85% ethyl acetate and 15% ethanol by volume (Blend B2)

Relative Effectiveness Only

It is significant to note that the subject experiments were intended to examine the relative effectiveness of the seven solvents and mixtures noted above. The experiments did not look for nor generate absolute extraction data.

Frame of Reference

Corn germ was selected as the oil containing material for all the experiments. The germ was obtained from a company that specializes in fractionating corn kernels, and was finely ground in a coffee grinder to yield approximately 500 g of reference test material.

The experiments were calibrated for the following constants and variables:

Amount of solid material used in each test run: 10 g

Total amount of solvent used for each primary extraction: 30 g

Total amount of solvent used for each secondary extraction: 15 g

Pressure: atmospheric

Temperature: 35° C. and 55° C.

Primary extraction time: 1 hour

Secondary extraction: 30 minutes

The above protocol translated into a total of 14 individual test runs.

Test Procedure

The solid material (10 g) was mixed with the solvent (30 g) and the extraction was carried out in a shaker for 1 hour. A water bath was used to maintain the desired temperature: 35° C. or 55° C. The organic phase was separated by 30 minutes of filtration with hardened paper.

The residue was extracted for a second time using 15 g of the same solvent for 30 minutes. The organic phase was separated again by 30 minutes of filtration with hardened paper.

The organic phases from the primary and secondary extractions were combined. The solvent and moisture were evaporated in a pre-heated oven at 110° C. for 1 hour and the weight of oil was measured using a balance.

Test results at 35° C.

| Solvent/mixture | Oil extracted (grams) |
|---|---|
| Ethanol | 0.14 |
| Ethyl lactate | 1.66 |
| Ethyl acetate | 1.63 |
| Ethyl lactate (95%) + ethanol (5%), Blend A1 | 1.83 |
| Ethyl lactate (85%) + ethanol (15%), Blend A2 | 1.91 |
| Ethyl acetate (95%) + ethanol (5%), Blend B1 | 1.80 |
| Ethyl acetate (85%) + ethanol (15%), Blend B2 | 1.85 |

Test results at 55° C.

| Solvent/mixture | Oil extracted (grams) |
|---|---|
| Ethanol | 0.15 |
| Ethyl lactate | 1.64 |
| Ethyl acetate | 1.65 |
| Ethyl lactate (95%) + ethanol (5%), Blend A1 | 1.84 |
| Ethyl lactate (85%) + ethanol (15%), Blend A2 | 1.92 |
| Ethyl acetate (95%) + ethanol (5%), Blend B1 | 1.75 |
| Ethyl acetate (85%) + ethanol (15%), Blend B2 | 1.73 |

CONCLUSIONS

In general, it was found that the extract temperature has a very minimal effect upon the extraction effectiveness of all seven solvents/mixtures.

The solvent blend consisting of 85% ethyl lactate and 15% ethanol shows the highest relative effectiveness in extracting the immobilized oil.

Various features, characteristics, components, or steps of any other system or method of extraction may be utilized within the systems and methods described herein. See, e.g., U.S. Pat. No. 7,572,468, U.S. Patent Publication No. 2003/0044495, U.S. Pat. No. 7,368,138, U.S. Patent Publication No. 2008/0193571, U.S. Patent Publication No. 2008/0160116, U.S. Pat. No. 3,867,262, U.S. Patent Publication No. 2008/0176298, which are hereby incorporated by reference in their entirety.

It should be understood from the foregoing that, while particular implementations have been illustrated and described, various modifications can be made thereto and are contemplated herein. It is also not intended that the invention be limited by the specific examples provided within the specification. While the invention has been described with reference to the aforementioned specification, the descriptions and illustrations of the preferable embodiments herein are not meant to be construed in a limiting sense. Furthermore, it shall be understood that all aspects of the invention are not limited to the specific depictions, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations and equivalents.

What is claimed is:

1. A process for extracting immobilized oils from oil containing materials, said process comprising:

providing an oil containing material; and providing a mixture of food grade solvents, comprising a blend of ethyl lactate and ethanol or a blend of ethyl acetate and ethanol, to said oil containing material, thereby extracting the immobilized oil from the oil containing materials.

2. The process of claim 1, wherein the ethanol content in the blend ranges from 1% to 25% by volume.

3. The process of claim 1, wherein the blend of ethyl lactate and ethanol or the blend of ethyl acetate and ethanol is recovered, separated from each other and recycled into the process.

4. The process of claim 1, wherein the blend of ethyl acetate and ethanol, or the blend of ethyl lactate and ethanol, is recovered as a mixture and recycled into the process.

5. The process of claim 1, wherein the oil containing material comprises ground wheat germ with an oil content that is greater than 15% by weight.

6. The process of claim 5, wherein a high protein solid residue that remains after the oil has been extracted is suitable for human consumption.

7. The process of claim 1, wherein the oil containing material is a feedstock with an oil content that is greater than 15% by weight.

8. The process of claim 1, wherein the extraction process is designed for increased cost-effectiveness for a feedstock throughput rate of 25,000 through 150,000 tons per year.

9. The process of claim 1, wherein the extraction process is used without limitations for any stipulated feedstock throughput rate.

10. A system for oil extraction comprising:

an extractor configured to receive a feedstock and a food grade solvent from a solvent source including ethanol, or ethanol and ethyl lactate or ethyl acetate, and to produce a mixed effluent;

a centrifuge configured to receive the mixed effluent and separate the mixed effluent into a plurality of streams; and a stripper configured to receive at least one of the plurality of streams, and separate the at least one stream into food grade oil, and additional products that are provided to the solvent source.

11. The system of claim 10 wherein the solvent source is a dehydration and surge tank.

12. The system of claim 10 further comprising a backwash configured to accept at least one of the plurality of streams from the centrifuge and separate the stream into a liquid stream returned to the centrifuge and a solid residue that is fed into a dryer.

13. The system of claim 10 further comprising a dryer configured to accept at least one of the plurality of streams from the centrifuge.

14. The system of claim 12 or claim 13 wherein the dryer produces a deoiled solid.

15. The system of claim 10 wherein the food grade oil is a vegetable oil.

16. A system for oil extraction comprising:

an extractor configured to receive an oil containing material and a food grade solvent from a solvent source including ethanol, and to produce a mixed effluent;

a centrifuge configured to receive the mixed effluent and separate the mixed effluent into a plurality of streams; and a stripper configured to receive at least one of the plurality of streams, and separate the at least one stream into food grade oil, and additional products that are provided to the solvent source.

* * * * *